United States Patent [19]

Gynn

[11] 3,933,140

[45] Jan. 20, 1976

[54] CAPACITIVE DISCHARGE IGNITION ADAPTER

[75] Inventor: George E. Gynn, Fort Wayne, Ind.

[73] Assignee: Syncro Corporation, Oxford, Mich.

[22] Filed: July 25, 1973

[21] Appl. No.: 382,475

[52] U.S. Cl. ..... 123/148 CC
[51] Int. Cl.[2] ..... F02P 1/00
[58] Field of Search ... 123/148 E, 148 OC, 148 MC

[56] References Cited

UNITED STATES PATENTS

| | | | |
|---|---|---|---|
| 3,367,314 | 2/1968 | Hirosawa | 123/148 MC |
| 3,704,397 | 12/1972 | Couch | 123/148 MC |
| 3,704,700 | 12/1972 | Wesemeyer | 123/148 MC |

*Primary Examiner*—Charles J. Myhre
*Assistant Examiner*—Ronald B. Cox
*Attorney, Agent, or Firm*—Harness, Dickey & Pierce

[57] ABSTRACT

An electrical ignition system for adapting a conventional, such as a breaker point type, ignition system of an engine to a capacitor discharge ignition system. A single adapter is compatible with both positive and negative polarity existing ignition systems.

37 Claims, 1 Drawing Figure

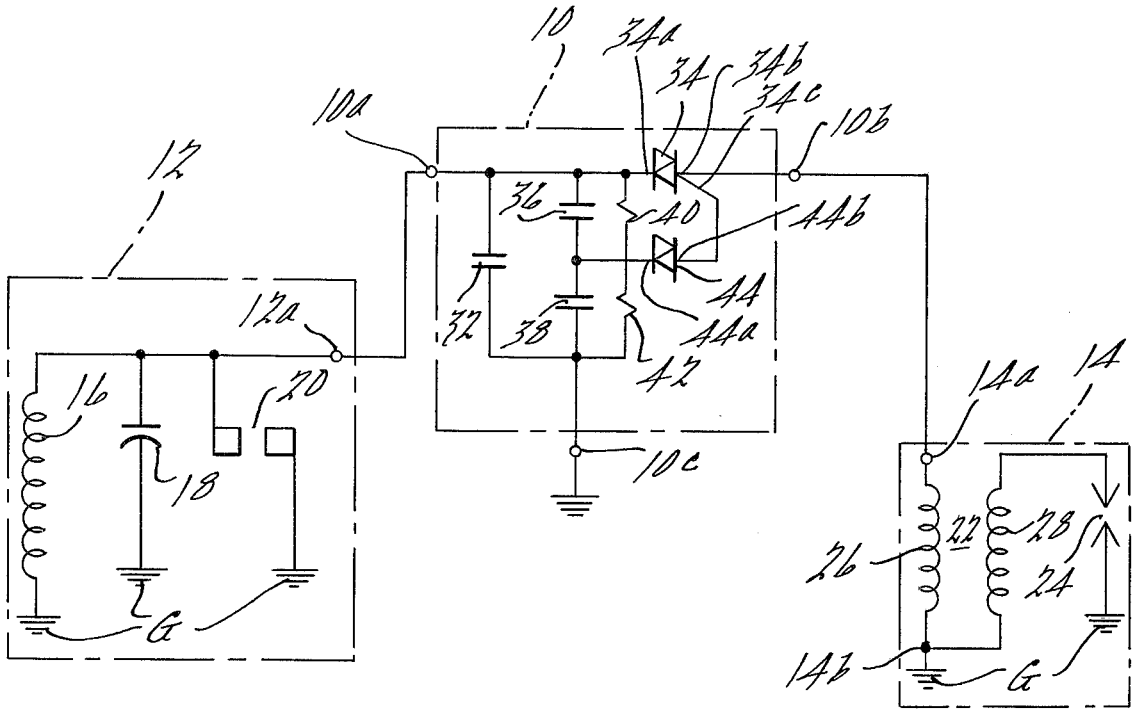
10
34a
34
34b
34c
10a
10b
12
36
40
44b
44
44a
32
38
42
12a
16
20
18
10c
14a
14
22
28
26
24
14b
G
G

CAPACITIVE DISCHARGE IGNITION ADAPTER

BACKGROUND SUMMARY OF THE INVENTION

The present invention relates to an adapter circuit for adapting a conventional ignition system of an engine to a capacitor discharge ignition system and, in particular, to an adapter circuit assembly which may be used with both existing positive and negative polarity systems.

The well-known advantages of a capacitor discharge ignition (CDI) system often render the conversion of an existing conventional ignition system to a CDI system desirable. Typically, the conventional ignition system comprises a source of electric energy which is controllably connected and disconnected to and from the primary winding of an ignition coil via a controlled conduction element such as a set of breaker points which are actuated at selected operating position(s) of the engine. In U.S. Pat. No. 3,704,397 and in U.S. patent application Ser. No. 315,139, both of which are assigned to the same assignee as the present application, there are disclosed embodiments of ignition adapter circuits for converting existing conventional ignition systems to CDI systems. Certain features of the present disclosure relate to improvements in certain features of the ignition adapter circuits disclosed in the aforementioned patent and application. One of these improvements is that the present invention provides a novel adapter circuit which may be used with both positive and negative polarity existing conventional ignition systems. Accordingly, the present invention has the advantage of reducing the number of unique types of adapter circuits required for accommodating both positive and negative polarity existing ignition systems which are to be converted to CDI systems. The adapter circuit according to the present invention also attains the desired objective of eliminating any need for mechanical revision or modification of existing ignition hardware when being installed. In other words, the adapter circuit of the present invention is installable by simply mounting the adapter on the engine and remarking at most a few simple electrical connections.

Additionally, the particular details of certain structure of the present invention attain marked improvements in operational performance of capacitor discharge ignition systems regardless of whether these ignition systems are original equipment CDI systems or conventional systems which have been converted to CDI. One of these improvements involves a novel triggering circuit which provides hard triggering for a triggerable solid state device through which a main capacitor discharges into the primary winding of the ignition coil. Another improvement is that either positive or negative capacitor voltages can be discharged into the primary winding of the ignition coil. As will be seen in the ensuing detailed description of the preferred embodiment, the circuit construction by which these advantageous features and benefits are attained requires a minimum number of individual circuit elements, and hence the preferred adapter circuit assembly may be manufactured economically and can attain high reliability. Accordingly, the invention is also directed to attaining improved operational performance in capacitor discharge ignition systems in general, and to minimizing the costs of such systems.

The foregoing advantages, benefits and features of the invention along with additional features will be seen in the ensuing description and claims which are to be taken in conjunction with the accompanying drawing.

BRIEF DESCRIPTION OF THE DRAWING

The drawing illustrates a preferred embodiment of the present invention in accordance with the best mode presently contemplated for carrying out the invention and, in particular, discloses an electrical schematic diagram of an ignition adapter circuit according to the present invention operatively coupled with a pre-existing conventional ignition system of a single cylinder engine to render it a CDI system.

DESCRIPTION OF THE PREFERRED EMBODIMENT

In the drawing, an ignition adapter circuit assembly 10 according to the present invention is coupled with a magneto ignition section 12 and an ignition coil and plug section 14. In the pre-existing conventional system for a single cylinder engine, section 12 is directly coupled with section 14.

Section 12 is illustrated by way of example as comprising a coil 16, a capacitor 18 and a set of breaker points 20. Coil 16 is mounted on the engine typically in fixed position on a stator (not shown). The stator is in proximity to a flywheel (not shown) which rotates with the engine. Coil 16 is energized by one or more sets of magnetic pole pairs (not shown) which rotate with the flywheel. In this way, as the flywheel turns, an alternating magnetic flux is developed in coil 16 which causes coil 16 to supply an alternating polarity output to its load. Coil 16, capacitor 18 and points 20 are connected in paralled with each other across an output terminal 12*a* and ground G. Breaker points 20 are mounted on the engine for actuation in timed relation with the rotation of the engine to achieve properly timed engine firing. Capacitor 18 is conventionally provided to minimize arcing across points 20.

Section 14 comprises an ignition coil 22 and a spark plug 24. Coil 22 comprises a primary winding 26 and a secondary winding 28 which are connected to a common grounded terminal 14*b*. Spark plug 24 is connected directly across secondary winding 28. In the pre-existing conventional ignition system, primary winding 26 is connected in parallel with points 20, capacitor 18 and coil 16 via an input terminal 14*a* and ground G, terminal 14*a* being directly connected to terminal 12*a*. In the conventional system, the opening of points 20 causes the output of coil 16 to be supplied to primary winding 26, the opening of points 20 occurring when the output of coil 16 is of a certain polarity; that is, of positive polarity in a positive polarity type system and of negative polarity in a negative polarity type system. The electrical energy suddenly delivered to primary winding 26 by the opening of points 20 in turn causes a rapid change in the magnetic flux linking windings 26 and 28 and hence a voltage to be developed across secondary winding 28 for firing spark plug 24. Thus plug 24 fires in timed relation with the opening of points 20 to produce desired fuel ignition within the engine cylinder.

In order to convert the pre-existing conventional ignition system to a CDI system, the connection between terminal 12*a* and terminal 14*a* is broken and adapter assembly circuit 10 is connected therebetween. An input terminal 10*a* of adapter 10 connects to terminal 12*a*, an output terminal 10*b* of adapter 10 to terminal 14*a* and a third terminal 10c of adapter 10 to ground G. Adapter 10 comprises a main capacitor 32 connected directly between terminal 10*a* and terminal 10*c* and hence directly as a load on section 12. A bidirectional triggerable solid state switch in the form of a triac 34 has its principal current path connected directly between terminals 10*a* and 10*b* with terminal 34*a* of triac 34 being connected directly to terminal 10*a*, and terminal 34*b* of triac 34 directly to terminal 10*b*. A triggering circuit for triac 34 comprises a pair of capacitors 36 and 38, a pair of resistors 40 and 42 and a bi-directional solid state breakdown device in the form of a diac 44. Capacitors 36 and 38 are connected in series with each other, and this series circuit is connected directly in parallel with capacitor 32 and is hence directly across the output of section 12. One terminal 44*a* of diac 44 connects to the junction of capacitors 36 and 38 and the other terminal 44*b* of diac 44 connects to the triggering terminal 34*c* of the triac. Resistor 40 shunts capacitor 36 and resistor 42 shunts capacitor 38. Thus the number of electrical circuit elements in adapter 10 is relatively small and the circuit may be economically fabricated. Since capacitor 32 and the series combination of capacitors 36 and 38 are connected directly across the output of section 12, positive voltage will be developed across these capacitors in response to positive polarity output of section 12 and negative voltage in response to negative output. Furthermore, since triac 34, once triggered, has bidirectional current carrying capability, either positive or negative voltage on the main capacitor 32 can be used to energize primary winding 26.

In the existing positive polarity breaker point system, section 12 is arranged and constructed to operate such that when points 20 open, the magnetic field existing in coil 16 suddenly collapses. Upon collapse of the magnetic field, a positive polarity voltage is developed at output terminal 12*a* to energize primary winding 26, thereby firing plug 24. Since coil 16 in effect discharges into primary winding 26 when points 20 open, the situation is that of an inductive source discharging into an inductive load; necessarily, the pre-existing conventional system is relatively sluggish in operation and requires a more involved construction of the charge coil and/or the ignition coil to develop sufficient energy transfer to fire the spark plug. The negative polarity system is identical to the positive polarity system except that when points 20 open, a negative voltage is developed at terminal 12*a* to energize primary winding 26.

In contrast to the relatively inefficient conventional breaker point system, adapter circuit assembly 10 when interconnected between sections 12 and 14 attains a more efficient operation and hence a more powerful spark is developed at plug 24. Thus with adapter circuit assembly 10 connected in a positive polarity system, the operation is as follows. When points 20 open, the voltage output of coil 16 is applied to an essentially purely capacitive load of capacitors 32, 36, 38. (Although the use of resistors 40 and 42 is preferred in that they impart a certain stability, it is contemplated that these could be omitted in certain constructions without departing from the present invention.) Since the capacitive load presented to coil 16 when points 20 open is essentially the antithesis of the inductive load imposed by primary winding 26 in the former (non-CDI) system, energy is rapidly transferred from the collapsing magnetic field in coil 16 to develop positive voltage across capacitors, 32, 36 and 38. Note that triac 34 is blocking conduction to primary winding 26 since it has not yet been triggered. More particularly, when points 20 open, capacitor 32 and the series string of capacitors 36 and 38 suddenly and extremely rapidly charge toward a relatively large positive voltage. Capacitors 36 and 38 divide this rapidly increasing voltage such that a fraction thereof is supplied to the terminal 44a of diac 44. Diac 44 is in a blocking condition until the voltage at terminal 44*a* reaches a selected level. When this level is reached, diac 44 suddenly becomes highly conductive. Capacitor 38 now discharges through diac 44 into the triggering terminal 34*c* of triac 34. This triggering signal supplied to traic 34 causes the triac to become highly conductive. As a result, capacitor 32, and for that matter capacitors 36 and 38, are now connected directly across primary winding 26 through triac 34. Capacitor 32 has a relatively large capacity in comparison to capacitors 36 and 38 and supplies a large majority of the energy for firing spark plug 24. Hence, the capacitors (primarily capacitor 32) discharge to energize primary winding 26 and thereby cause spark plug 24 to fire. Since a capacitive source is discharging into an inductive load, energy is transferred very rapidly and efficiently and maximum spark energy is attained. When points 20 again close, any energy which remains in the circuit is dissipated and hence in this way, diac 44 and triac 34 are returned to their blocking states before the next cycle. Capacitors 36, 38 and diac 44 are selected such that voltage supplied to diac 44 causes breakdown thereof at the time that the desired voltage to be discharged into primary winding 26 is developed across capacitor 32. Because of the unique triggering circuit of the invention, triac 34 is fired by hard triggering, and this helps to attain optimum response and performance, In a negative polarity type system adapter circuit 10 operates in the same fashion with respect to negative voltage as it did in the positive polarity system with respect to positive voltages. Thus in the negative system when points 20 open, capacitors 32 and the series string of capacitors 36 and 38 charge suddenly and very rapidly toward a relatively large negative voltage. Since diac 44 has substantially identical breakdown characteristics with respect to both positive and negative voltages, diac 44 breaks down when the magnitude of the negative voltage developed at the junction of capacitors 36 and 38 reaches the same magnitude of the positive voltage that was sufficient to break down diac 44 when adapter assembly circuit 10 was connected in the positive polarity system. At this time, the magnitude of the voltage across capacitor 32 is also the same as it was in the positive. Thus, too, in the negative polarity system, diac 44 breaks down when the voltage across capacitor 32 reaches the desired level which is to be discharged through triac 34 into primary winding 26. Because triac 34 is triggerable in both first and third quadrants with triggering characteristics of substantially the same magnitude although of different sign, triac 34 in the negative polarity system triggers into conduction in response to breakdown of diac 44. Thus the negative polarity voltage developed on capacitor 32 now discharges into primary winding 26, thereby firing spark plug 24. When points 20 again close, any energy remaining in the circuit is dissipated and diac 44 and triac 34 return to their blocking states in preparation for the next cycle.

Thus from the foregoing description it can be seen that adapter circuit 10 can be used in both positive and negative polarity systems and when used in either, attains the same fast and efficient operational performance. In accordance with the preferred embodiment of the invention, the values of capacitors 32, 36 and 38 should be selected to provide the desired voltage and energy requirements for both diac 44 and triac 34 as well as for discharging into primary winding 26. Thus capacitors 32, 36 an 38 should provide a load on coil 16 such that capacitor 32 can be charged to the desired voltage level which is to be discharged into primary winding 26. Capacitors 36 and 38 should be selected to provide the desired voltage dividing action required for breaking down diac 44 when the desired voltage across capacitor 32 is reached. Capacitors 36 and 38 should also provide the necessary power requirements for energizing triac 34 to initiate conduction thereof. Because of the hard triggering provided by the circuit of the present invention, the system has the advantage of providing maximum spark energy at virtually any engine operating speed. A further advantage of hard triggering which is believed present in the specific circuit disclosed in the drawing is that excessive heating in the triac 34, which might otherwise occur with softer types of triggering, is eliminated.

It is to be understood that the foregoing description is that of a preferred embodiment of the invention. Various changes and modifications may be made without departing from the spirit and scope of the invention as defined by the appended claims.

What is claimed is:

1. For a single cylinder engine having an existing ignition system of the type comprising a source of electrical power, an ignition coil for the single cylinder of said engine having primary and secondary windings, a spark plug for the single cylinder of said engine operatively coupled with said secondary winding and means operatively coupling said source of power with said primary winding comprising a controlled conduction device operatively connected to the engine to be alternately changed from a conductive to a non-conductive condition in timed relation with the engine to cause said spark plug to fire, an adapter circuit assembly for converting the existing ignition system to a capacitor discharge ignition system and interconnectable between said controlled conduction device and said primary winding, said adapter circuit assembly comprising:

a capacitor means;

input circuit means for operatively coupling said capacitor means with said controlled conduction device and said source of power such that said capacitor means is charged from said source of power when the conduction of said controlled conduction device is changed; and output circuit means including a triac having blocking and conducting states and comprising a trigger terminal via which said element is switched from the blocking state to the conducting state, and including a diac operatively coupling said capacitor means with said trigger terminal, said triac operatively coupling said capacitor means with said primary winding, said diac being responsive to the magnitude of charge voltage across said capacitor means as said capacitor means charges subsequent to the change of conduction of said first controlled conduction device for switching said triac from its blocking state to its conducting state after said magnitude of charge voltage has attained a predetermined level to discharge said capacitor means into said primary winding and thereby cause the spark plug to fire.

2. The adapter circuit assembly of claim 1 wherein said input circuit means is arranged such that said capacitor means is connected directly across said source of power when the conduction of said controlled conduction device is changed.

3. The adapter circuit assembly of claim 1 wherein said trigger circuit means comprises a capacitor network.

4. The adapter circuit assembly of claim 3 wherein said capacitor network comprises first and second capacitors connected in series with each other and across said capacitor means.

5. For an engine having an existing ignition system of the type comprising a source of electrical power, an ignition coil having primary and secondary windings, a spark plug operatively coupled with said second winding and means operatively coupling said source of power with said primary winding comprising a controlled conduction device actuable in timed relation with the engine to cause said spark plug to fire, an adapter circuit assembly for converting the existing ignition system to a capacitor discharge ignition system and interconnectable between said controlled conduction device and said primary winding, said adapter circuit assembly comprising: a capacitor means; input circuit means for operatively coupling said capacitor means with said controlled conduction device and said source of power such that said capacitor means is charged from said source of power when said controlled conduction device is actuated; and output circuit means for operatively coupling said capacitor means with said primary winding; said output circuit means including means responsive to the voltage developed across said capacitor means for causing said capacitor means to discharge into said primary winding and thereby cause the spark plug to fire comprising a solid state triggerable element having blocking and conducting states and comprising a trigger terminal via which said element is switched from the blocking state to the conducting state; and including trigger circuit means, comprising a capacitor network comprising first and second capacitors connected in series with each other and across said capacitor means and resistance means operatively coupled in circuit with said first and second capacitors, operatively coupling said capacitor means with said trigger terminal for switching said solid state triggerable element from its blocking state to its conducting state when the voltage across said capacitor means reaches a selected level whereby said capacitor means then discharges through said solid state triggerable element into said primary winding.

6. The adapter circuit assembly of claim 5 wherein said resistor means comprises a pair of resistors each of which is in parallel with one of said first and second capacitors.

7. The adapter circuit assembly of claim 6 wherein said trigger circuit means further includes a bi-directional breakdown circuit element operatively coupled between the junction of said first and second capacitors and the trigger terminal of said solid state triggerable element.

8. The adapter circuit assembly of claim 7 wherein said bi-directional breakdown circuit element comprises a diac.

9. The adapter circuit assembly of claim 8 wherein said solid state triggerable element comprises a triac.

10. The adapter circuit assembly of claim 1 wherein said trigger circuit means includes a capacitor network operatively coupled with said capacitor means for supplying a fraction of the voltage developed across said capacitor means through said diac to the trigger terminal of said triac.

11. For an engine having an existing ignition system of the type comprising a source of electrical power, an ignition coil having primary and secondary windings, a spark plug operatively coupled with said secondary winding and means operatively coupling said source of power with said primary winding comprising a first controlled conduction device operatively connected to the engine to be alternately changed from a conductive to a non-conductive condition in timed relation with the engine to cause said spark plug to fire, an adapter circuit assembly for converting the existing ignition system to a capacitor discharge ignition system and interconnectable between said first controlled conduction device and said primary winding, said adapter circuit assembly comprising: a capacitor means; input circuit means for operatively coupling said capacitor means with said first controlled conduction device and said source of power such that said capacitor means is charged from said source of power when the conduction of said first controlled conduction device is changed; and output circuit means including a solid state triggerable triac having blocking and conducting states and comprising a trigger terminal via which said triac is switched from the blocking state to the conducting state for operatively coupling said capacitor means with said primary winding, said output circuit means including trigger circuit means including a bi-directional breakdown diac and a pair of capacitors connected in series with each other and directly across said capacitor means for supplying a fraction of the voltage developed across said capacitor means through said diac to the trigger terminal of said triac, said diac being broken down to initiate triggering of said triac from its blocking state to its conducting state when the voltage across said capacitor means reaches a selected level after the change of conduction of said first controlled conduction device for causing said triac to conduct to discharge said capacitor means into said primary winding and thereby cause the spark plug to fire.

12. For converting both positive polarity and negative polarity type existing ignition systems to capacitor discharge ignition systems wherein each polarity existing system comprises a source of electric power for supplying an output voltage, an ignition coil having primary and secondary windings, a spark plug operatively coupled with said secondary winding and means operatively coupling said source of power with the primary winding comprising a first controlled conduction device operatively connected to the engine to be alternately changed from a conductive to a non-conductive condition in timed relation with the operation of the engine to cause the spark plug to fire, an adapter circuit assembly for operative interconnection with the existing ignition system, said adapter circuit assembly comprising: capacitor means; input circuit means for operatively coupling said capacitor means with said first controlled conduction device and said source of power such that said capacitor means is charged to either a positive or a negative polarity upon actuation of said first controlled conduction device; and output circuit means including a bi-directional second controlled conduction device for operatively coupling said capacitor means with the primary winding, said output circuit means including means responsive to the attainment of both a positive polarity and a negative polarity voltage across said capacitor means of a predetermined magnitude after the change of conduction of said first controlled conduction device for causing said second controlled conduction device to conduct to discharge said capacitor means into said primary winding and thereby cause the spark plug to fire.

13. The adapter circuit assembly of claim 12 wherein said second controlled conduction device is a solid state triggerable switch element comprising a trigger terminal via which said element is switched from a blocking state to a conducting state, said switch element having bi-directional current-carrying capability when in its conducting state; and including trigger circuit means operatively coupling said capacitor means with said trigger terminal for switching said switch element from its blocking state to its conducting state when the voltage across said capacitor means reaches a selected level whereby said capacitor means then discharges through said switch element into said primary winding.

14. The adapter circuit assembly of claim 13 wherein said switch element comprises a triac.

15. The adapter circuit assembly of claim 13 wherein said trigger circuit means includes a bi-directional breakdown circuit element which is broken down to initiate triggering of said switch element.

16. The adapter circuit assembly of claim 15 wherein said breakdown element comprises a diac.

17. The adapter circuit assembly of claim 16 wherein said trigger circuit means includes a capacitor network.

18. For converting both positive polarity and negative polarity type existing ignition systems to capacitor discharge ignition systems wherein each polarity existing system comprises a source of electric power for supplying an output voltage, an ignition coil having primary and secondary windings, a spark plug operatively coupled with said secondary winding and means operatively coupling said source of power with the primary winding comprising a controlled conduction device actuatable in timed relation with the operation of the engine to cause the spark plug to fire, an adapter circuit assembly for operative interconnection with the existing ignition system, said adapter circuit assembly comprising: capacitor means; input circuit means for operatively coupling said capacitor means with said controlled conduction device and said source of power such that said capacitor means is charged upon actuation of said controlled conduction device; and output circuit means operatively coupling said capacitor means with the primary winding, said output circuit means including means responsive to voltage across said capacitor means for causing said capacitor means to discharge into said primary winding and thereby cause the spark plug to fire comprising a solid state triggerable switch element comprising a trigger terminal via which said element is switched from a blocking state to a conducting state, said switch element having bi-directional current-carrying capability when in its conducting state; and including trigger circuit means, including a bi-directional breakdown diac which is broken down to initiate triggering of said switch element and a capacitor network comprising a pair of capacitors connected in series and across said capacitor means for supplying a fraction of the voltage across said capacitor means to the trigger terminal of said switch element, operatively coupling said capacitor means with said trigger terminal for switching said switch element from its blocking state to its conducting state when the voltage across said capacitor means reaches a selected level whereby said capacitor means then discharges through said switch element into said primary winding.

19. The adapter circuit assembly of claim 18 wherein said switch element comprises a triac.

20. The adapter circuit assembly of claim 13 wherein said trigger circuit comprises a pair of capacitors for supplying a fraction of the voltage developed across said capacitor means to the trigger terminal of said switch element.

21. The adapter circuit assembly of claim 20 wherein said switch element comprises a triac.

22. For converting both positive polarity and negative polarity type existing ignition systems to capacitor discharge ignition systems wherein each polarity existing system comprises a source of electric power for supplying an output voltage, an ignition coil having primary and secondary windings, a spark plug operatively coupled with said secondary winding and means operatively coupling said source of power with the primary winding comprising a first controlled conduction device operatively connected to the engine to be alternately changed from a conductive to a non-conductive condition in timed relation with the operation of the engine to cause the spark plug to fire, an adapter circuit assembly for operative interconnection with the existing ignition system, said adapter circuit assembly comprising: capacitor means, input circuit means for operatively coupling said capacitor means with said first controlled conduction device and said source of power such that said capacitor means is charged upon actuation of said first controlled conduction device; and output circuit means including a triac for operatively coupling said capacitor means with the primary winding having a trigger terminal via which said triac is switched from a blocking state to a conducting state, said triac having bidirectional current-carrying capability when in its conducting state, said output circuit means including trigger circuit means operatively coupling said capacitor means with said trigger terminal for switching said triac from its blocking state to its conducting state when the voltage across said capacitor means reaches a selected level after the change of conduction of said first controlled conduction device for causing said capacitor means to discharge into said primary winding and thereby cause the spark plug to fire, said trigger circuit comprising a pair of capacitors for supply a fraction of the voltage developed across said capacitor means to the trigger terminal of said triac and a diac connected between said pair of capacitors and the trigger terminal of said triac.

23. For an engine having an existing magneto-spark ignition system which comprises a coil for supplying an output waveform, an ignition coil having primary and secondary windings, a spark plug operatively coupled with said secondary winding and means operatively coupling the coil with the primary winding comprising a first controlled conduction device operatively connected to the engine to be alternately changed from a conductive to a nonconductive condition in timed relation with the operation of the engine for causing the spark plug to fire, said existing magneto-spark ignition system being either a positive polarity type wherein said primary winding is energized by a positive polarity portion of said output waveform or a negative polarity type wherein said primary winding is energized by a negative polarity portion of said output waveform, an adapter circuit assembly for converting either polarity type ignition system to a capacitor discharge ignition system and interconnectable between the first controlled conduction device and the primary winding, said adapter circuit assembly comprising: a capacitor means, input circuit means for operatively coupling said capacitor means with the first controlled conduction device and the coil such that said capacitor means is charged by said positive polarity portion of the output waveform of the coil when the adapter is coupled with a positive polarity system and is charged by said negative polarity portion of the coil output waveform when the adapter is coupled in a negative polarity system and output circuit means including a second controlled conduction device for operatively coupling said capacitor means with the primary winding, said output circuit means including means responsive to either the positive polarity or the negative polarity voltage developed across said capacitor means upon the change of conduction of said first controlled conduction device for causing said second controlled conduction device to discharge said capacitor means into the primary winding.

24. The adapter circuit assembly of claim 23 wherein said second controlled conduction device is a solid state triggerable switch element comprising a trigger terminal via which said element is switched from a blocking state to a conducting state, said switch element having bi-directional current-carrying capability when in its conducting state; and including trigger circuit means operatively coupling said capacitor means with said trigger terminal for switching said switch element from its blocking state to its conducting state when the voltage across said capacitor means reaches a selected level whereby said capacitor means then discharges through said switch element into said primary winding.

25. The adapter circuit assembly of claim 24 wherein said switch element comprises a triac.

26. The adapter circuit assembly of claim 24 wherein said trigger circuit means includes a bi-directional breakdown circuit element which is broken down to initiate triggering of said switch element.

27. The adapter circuit assembly of claim 26 wherein said breakdown element comprises a diac.

28. The adapter circuit assembly of claim 27 wherein said trigger circuit means includes a capacitor network.

29. The adapter circuit assembly of claim 28 wherein said capacitor network comprises a pair of capacitors connected in series and across said capacitor means for supplying a fraction of the voltage across said capacitor means to the trigger terminal of said switch element.

30. The adapter circuit assembly of claim 29 wherein said switch element comprises a triac.

31. The adapter circuit assembly of claim 24 wherein said trigger circuit comprises a pair of capacitors for supplying a fraction of the voltage developed across said capacitor means to the trigger terminal of said switch element.

32. The adapter circuit assembly of claim 31 wherein said switch element comprises a triac.

33. For an engine having an existing magneto-spark ignition system which comprises a coil for supplying an output waveform, an ignition coil having primary and secondary windings, a spark plug operatively coupled with said secondary winding and means operatively coupling the coil with the primary winding comprising a first controlled conduction device operatively connected to the engine to be alternately changed from a conductive to a non-conductive condition in timed relation with the operation of the engine for causing the spark plug to fire, said existing magneto-spark ignition system being either a positive polarity type wherein said primary winding is energized by a positive polarity portion of said output waveform or a negative polarity type wherein said primary winding is energized by a negative polarity portion of said output waveform, an adapter circuit assembly for converting either polarity type ignition system to a capacitor discharge ignition system and interconnectable between the first controlled conduction device and the primary winding, said adapter circuit assembly comprising: a capacitor means with the first controlled conduction device and the coil such that said capacitor means is charged by said positive polarity portion of the output waveform of the coil when the adapter is coupled with a positive polarity system and is charged by said negative polarity portion of the coil output waveform when the adapter is coupled in a negative polarity system and output circuit means including a triac for operatively coupling said capacitor means with the primary winding comprising a trigger terminal via which said triac is switched from a blocking state to a conducting state, said triac having bi-directional current-carrying capability when in its conducting state, said output circuit means including trigger circuit means operatively coupling said capacitor means with said trigger terminal for switching said triac from its blocking state to its conducting state when the voltage across said capacitor means reaches a selected level after the change of conduction of said first controlled conduction device for causing said triac to discharge said capacitor means into the primary winding, said trigger circuit comprising a pair of capacitors for supplying a fraction of the voltage developed across said capacitor means to the trigger terminal of said triac and a diac connected between said pair of capacitors and the trigger terminal of said triac.

34. For an engine having means for supplying electrical power of either positive or negative polarity voltage and a spark plug which is fired via an ignition coil by energy from said source of power in timed relation with the operation of the engine, a capacitor discharge ignition system for said engine, said capacitor discharge ignition system comprising: capacitor means; input circuit means for operatively coupling said capacitor means with said source of electrical power, a triac for operatively coupling said capacitor means with said ignition coil, said switch element comprising a trigger terminal, and triggering circuit means comprising first and second capacitor elements connected in series with each other and across said capacitor means and a bi-directional breakdown circuit element operatively coupling the junction of said first and second capacitor elements to the trigger terminal of said triac for causing said triac to be triggered into conduction when the voltage across said capacitor means reaches a predetermined level whereby said capacitor means is discharged to cause said spark plug to fire.

35. The capacitor discharge ignition system of claim 34 wherein said bi-directional breakdown circuit element comprises a diac.

36. The capacitor discharge ignition system of claim 35 wherein said triggering circuit means further includes a first resistor element connected in shunt with said first capacitor element and a second resistor element connected in shunt with said second capacitor element.

37. For an engine having means for supplying electrical power of either positive or negative polarity voltage and a spark plug which is fired via an ignition coil by energy from said source of power in timed relation with the operation of the engine, a capacitor discharge ignition system for said engine, said capacitor discharge ignition system comprising: capacitor means; input circuit means for operatively coupling said capacitor means with said source of electrical power, a triac for operatively coupling said capacitor means with said ignition coil, said triac comprising a trigger terminal, and triggering circuit means comprising first and second capacitors connected in series with each other and across said capacitor means and a bi-directional breakdown circuit element having a pair of terminals, one of said terminals of said bi-directional breakdown circuit element being connected to the trigger terminal of said triac and means coupling the junction of said capacitors with said other terminal of said bi-directional breakdown circuit element such that at least a fraction of the voltage developed across said capacitor means is applied to said other terminal of said bi-directional breakdown circuit element so that said bi-directional breakdown circuit element breaks down when the voltage across said capacitor means reaches said predetermined level whereby said bi-directional breakdown circuit element conducts a triggering signal to the trigger terminal of said triac to thereby trigger said triac into conduction for discharging said capacitor means and causing said spark plug to fire.

* * * * *

UNITED STATES PATENT AND TRADEMARK OFFICE

CERTIFICATE OF CORRECTION

PATENT NO. : 3,933,140

DATED : January 20, 1976

INVENTOR(S) : George E. Gynn

It is certified that error appears in the above-identified patent and that said Letters Patent are hereby corrected as shown below:

Column 1, line 42, "remarking" should be --remaking--.

Column 9, line 54, Claim 22, line 36, "supply" should be --supplying--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*